United States Patent [19]

Akerib

[11] Patent Number: 4,960,098

[45] Date of Patent: Oct. 2, 1990

[54] METHOD AND APPARATUS FOR MAINTAINING OPTIMUM OXYGEN LEVEL IN COMBUSTION ENGINES

[75] Inventor: Richard Akerib, Westminster, Colo.

[73] Assignee: E-Quad, Inc., Westminster, Colo.

[21] Appl. No.: 222,058

[22] Filed: Jul. 8, 1988

[51] Int. Cl.[5] ..... F02M 23/00

[52] U.S. Cl. ..... 123/589; 123/585

[58] Field of Search ..... 123/585, 586, 589, 567

[56] References Cited

U.S. PATENT DOCUMENTS

| | | | |
|---|---|---|---|
| 3,556,066 | 1/1971 | Muirhead | 123/575 |
| 3,738,341 | 6/1973 | Loos | 123/440 |
| 3,745,768 | 7/1973 | Zechnall | 60/276 |
| 3,851,632 | 12/1974 | Teshirogi et al. | 123/569 |
| 3,890,946 | 6/1975 | Wahl | 123/440 |
| 4,361,123 | 11/1982 | Hori et al. | 123/589 |
| 4,376,427 | 3/1983 | Mizuno | 123/589 |
| 4,494,374 | 1/1985 | Kitahara et al. | 123/589 |
| 4,705,012 | 11/1987 | Kawanabe et al. | 123/589 |
| 4,715,350 | 12/1987 | Kawanabe et al. | 123/589 |

*Primary Examiner*—Andrew M. Dolinar
*Assistant Examiner*—M. Macy
*Attorney, Agent, or Firm*—John E. Reilly

[57] ABSTRACT

A method and apparatus for maintaining the optimum oxygen level in a power plant, such as, an internal combustion engine comprises a combination of a pollutant sensor associated with the exhaust of the engine to generate electrical signals proportional to the level of pollutants in the exhaust stream, a supplementary oxygen source and a flow control valve which is responsive to the signal generated by the pollutant sensor to open the valve for flow of oxygen at a flow rate proportional to the electrical signal until the pollutant level is reduced to a predetermined value.

10 Claims, 2 Drawing Sheets

METHOD AND APPARATUS FOR MAINTAINING OPTIMUM OXYGEN LEVEL IN COMBUSTION ENGINES

SPECIFICATION

This invention relates to an oxygen controller for power plants; and more particularly relates to a novel and improved method and apparatus for regulating the supply of oxygen to a carburetor in direct response to the pollutant levels sensed in the exhaust of a power plant, such as, internal combustion engines, furnaces and the like.

BACKGROUND AND FIELD OF THE INVENTION

In the operation and maintenance of power plants, such as, internal combustion engines, the products of combustion contain a number of pollutants or noxious components in the exhaust gas or fumes. It is generally recognized that the more complete or efficient the combustion of fuel, the greater the reduction in the pollutants present in the exhaust and greater overall economy and performance of the engine. Thus, while catalytic converters have been employed in the exhaust system which are effective in reducing pollutant levels to some extent, they do not improve the economy or performance of the engine and do not satisfactorily reduce all pollutants present in the exhaust.

It has been proposed in the past to employ pollutant sensors in the exhaust of a motor vehicle to regulate the fuel/air ratio or mixture. Typically, however, such sensors are utilized to regulate the fuel in order to make the mixture either richer or leaner. Although this will contribute to some degree to maintain the combustion gases closer to the stoichiometric condition, it is not nearly as effective as regulating the delivery of a supplementary source of oxygen under pressure into the fuel/air mixture. The use of pure oxygen thereby avoids the introduction of additional nitrogen, for example, by increasing the ratio of oxygen to nitrogen in the air from 21% oxygen to 79% nitrogen to 23% oxygen to 77% nitrogen and has been found to be vastly more effective in maintaining the desired stoichiometric condition.

Other systems have been devised for reducing the pollutant level and achieving more complete combustion either by regulating the fuel/air mixture and/or by recirculating the products of combustion from the exhaust back through the carburetion system. For example, U.S. Letters Pat. No. 3,851,632 to Teshirogi is directed to a method and apparatus for controlling the pollutant level in the exhaust fumes of a diesel engine by recirculating the fumes and adding oxygen to the recirculated fumes when the oxygen level in the exhaust gases falls below a predetermined amount. Specifically, Teshirogi determines a particular level of oxygen to be maintained in the recirculation of the exhaust and injects oxygen as a function of the pollutants present in the exhaust. However, the system necessarily requires that engine power be utilized to recirculate the exhaust gases for more complete burning and ultimate reduction in the pollutant level. Other approaches have been taken to increase engine performance by regulating the amount of fuel in the fuel/air ratio as typified by U.S. Letters Pat. No. 3,738,341 to Loos and No. 3,745,768 to Zechnall et al. However, no attempt has been made to control the oxygen content in the air intake and to do so in direct response to the pollutant level in the exhaust.

In this relation it is highly desirable to be able to accurately and closely control the amount of oxygen delivered in direct response to the pollutant level in the exhaust.

U.S. Letters Pat. No. 3,556,066 to Muirhead combines oxygen with a supplementary fuel to introduce into the fuel/air mixture but not in response to a particular pollutant level and is concerned more with the metering of the amount of fuel in relation to the amount of supplemental oxygen supplied to the carburetor. In this regard it is important to establish the optimum stoichiometric condition of the power plant or engine and to regulate the amount of oxygen furnished to the carburetion system necessary to maintain the stoichiometric condition.

SUMMARY OF INVENTION

It is an object of the present invention to provide for novel and improved method and apparatus for delivering metered amounts of oxygen to a combustion engine in direct response to excess pollutants present in the spent combustion gases or exhaust of the system.

Another object of the present invention is to provide for a novel and improved method and means for producing an electrical signal in direct response to excess pollutants in the exhaust and for applying that signal to a flow control valve to accurately regulate the amount of oxygen supplied to a carburetor.

A further object of the present invention is to provide for a novel and improved flow control valve for regulating the supply of oxygen to a carburetor in direct response to an electrical signal which represents the level of excess pollutants in an exhaust and to maintain an optimum stoichiometric condition in the exhaust without necessity of recirculating exhaust gases through the carburetor.

In accordance with the present invention, a preferred form of apparatus for reducing the pollutant level in the exhaust resulting from incomplete combustion in an internal combusion engine includes a pollutant sensor disposed in the exhaust of the engine to continuously generate electrical signals proportional to the level of pollutants resulting from incomplete combustion in the spent combustion gases, a source of oxygen under pressure, a conduit interconnecting the oxygen source to the intake manifold directly upstream of the carburetor, and flow control valve means having an adjustable valve member which is responsive to the strength of the electrical signal to open the valve means for the flow of oxygen from the oxygen source at a flow rate correlated with the electrical signal thereby regulating the oxygen level in the air stream directed into the carburetor for mixing with the fuel as a preliminary to combustion.

A method for reducing the pollutant level in the exhaust of an internal combustion engine resulting from incomplete combustion comprises the steps of sensing the pollutant level in the exhaust fumes of the engine and producing an electrical signal proportional to the concentration of pollutants, providing a supplementary oxygen source which is mixed with the air stream preliminary to mixture with the fuel in the carburetor of the engine, regulating the amount of oxygen delivered from the supplementary oxygen source into the air stream in direct proportion to the electrical signal generated, and continuously monitoring the pollutant level in relation to the oxygen delivered to the air stream from the supplementary oxygen source.

The above and other objects, advantages and features of the present invention will become more readily appreciated and understood from the following detailed description when taken together with the accompanying drawings, in which:

DETAILED DESCRIPTION OF THE PREFERRED EMBODIMENT

Figure 1:
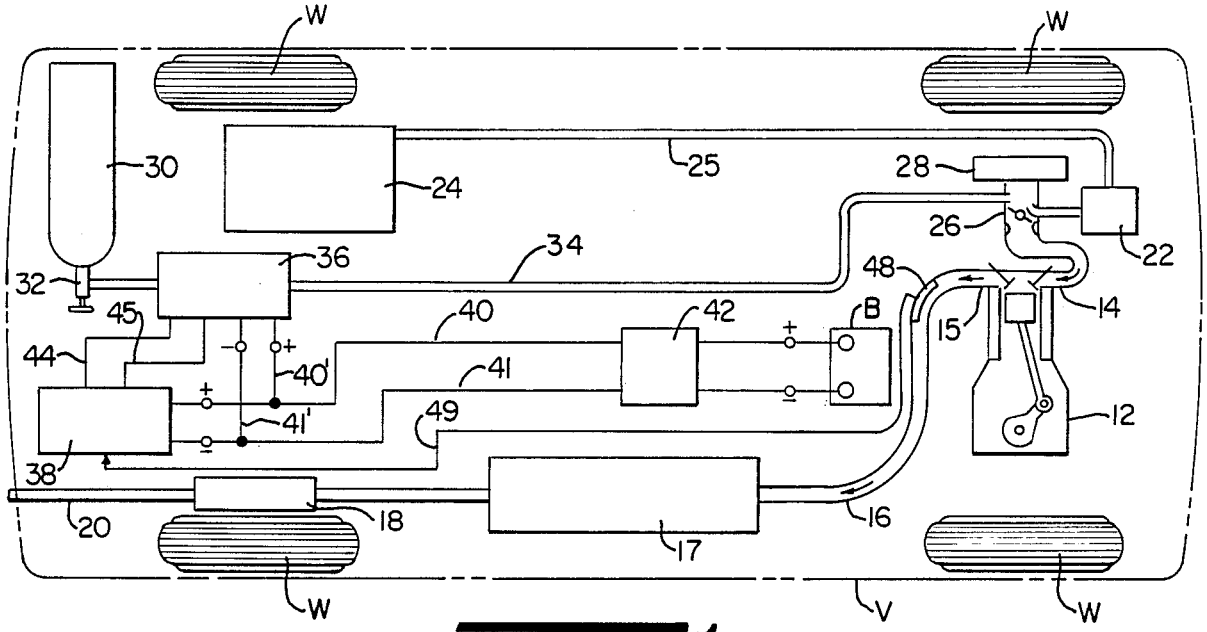
FIG. 1 is a schematic view illustrating a preferred form of apparatus in an internal combustion engine, in accordance with the present invention.

Referring in more detail to the drawings, there is shown by way of illustrative example in FIG. 1 a preferred form of oxygen control apparatus in an internal combustion engine for a motor vehicle generally designated at V. It is emphasized that the application of the apparatus of the present invention to an internal combustion engine, as illustrated in FIG. 1, is given more for the purpose of illustration and not limitation, and broadly, it has application to various power plants requiring intermixture of fuel and air as a preliminary to combustion. Thus, typical applications may be to internal combustion engines, furnaces, jet engines, and virtually any power plant in which a fuel source is intermixed with air for combustion and generation of power.

In the setting illustrated in FIG. 1, the motor vehicle V includes ground-engaging wheels W, and a combustion engine 12 has an intake manifold 14 and exhaust manifold 15 through which spent combustion gases are delivered via exhaust line 16 through catalytic converter 17 and a muffler 18 in the tail pipe section 20 to be exhausted into the atmosphere. A conventional carburetor 22 receives fuel such as gasoline from a fuel tank 24 via fuel line 25 for delivery into an induction pipe 26 upstream of the intake manifold 14. Air is drawn through a conventional filter 28 into the induction pipe 26 and, in accordance with the present invention, a supplementary source of oxygen in the form of an oxygen cylinder 30 has a pressure regulator 32 for delivery of oxygen under pressure from the cylinder 30 through a conduit 34 into the induction pipe 26. The oxygen may be drawn from suitable sources other than the cylinder 30 and, for example, may be provided by directing air through a molecular sieve, not shown, for delivery under pressure into the pipe 26. At the point of introduction into the pipe 26, the oxygen is preferably mixed with the air prior to intermixture of the air with the fuel in the carburetor region.

In the preferred form of the present invention, a flow control valve 36 is positioned in the flow line of conduit 34 between the cylinder 30 and the induction pipe 26 to regulate the flow rate of oxygen delivered into the induction pipe 26 for mixture with the air in response to a control signal representing the pollutant level in the exhaust line 16 and delivered by a sensing circuit 38 to the control valve 36. Positive and negative leads 40 and 41, respectively, extend from a battery designated at 8 through ignition switch 42 into the sensing circuit 38, and positive and negative leads 40' and 41' are connected off of the main leads 40 and 41 into the flow control valve 36. The sensing circuit 30 is broadly operative to produce an electrical signal and deliver same over output leads 44, 45 to the flow control valve 36 in response to the pollutant level sensed in the exhaust line 16 by a sensor element 48.

Figure 8:
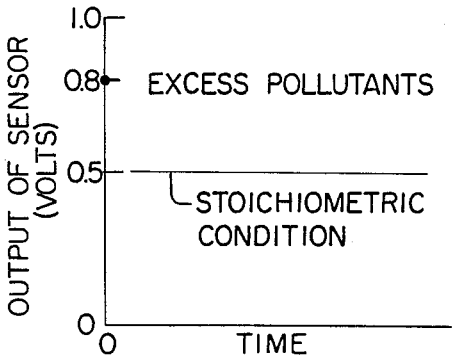
FIG. 8 is a graph of the pollutant sensor output voltage versus time and indicating the excess pollutant level above the stoichiometric condition.
Figure 6:
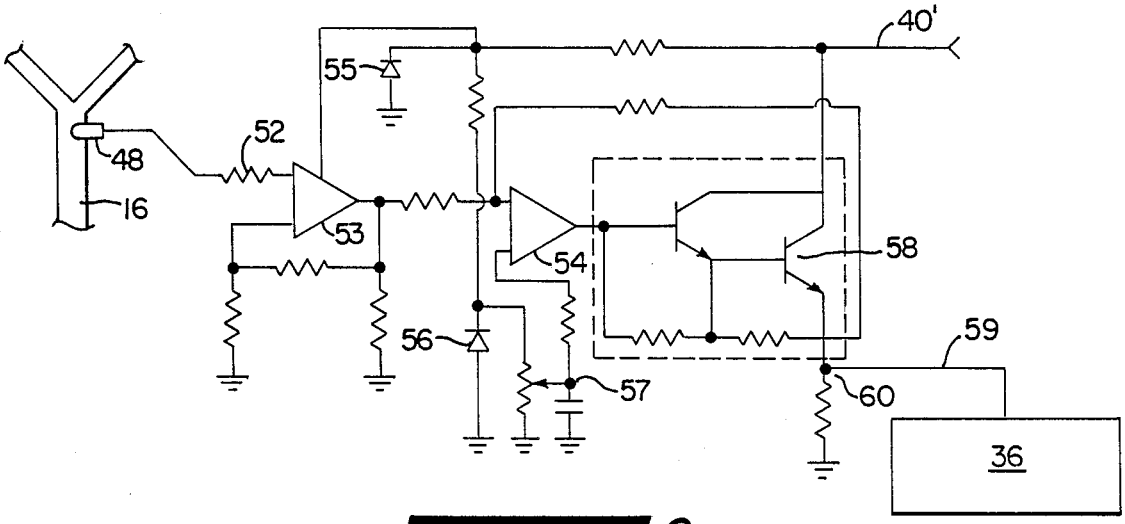
FIG. 6 is a block diagram of a preferred form of pollutant level sensing circuit in accordance with the present invention.
Figure 2:
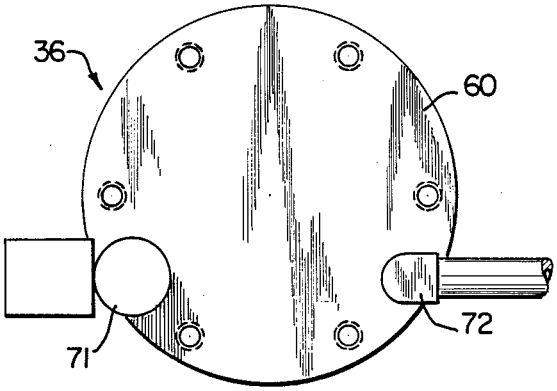
FIG. 2 is a top plan view of a preferred form of oxygen flow control valve.
Figure 4:
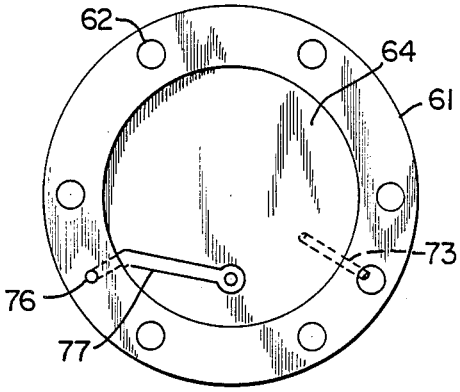
FIG. 4 is a cross-sectional view taken about lines 4—4 of FIG. 3.
Figure 3:
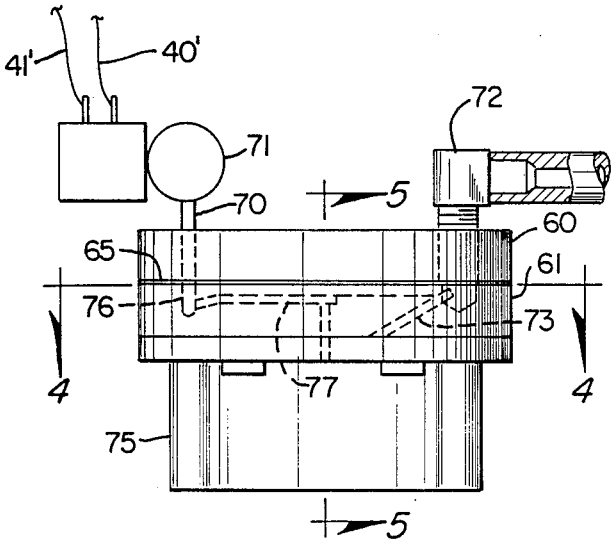
FIG. 3 is a front view in elevation of the preferred form of the flow control valve shown in FIG. 2.
Figure 5:
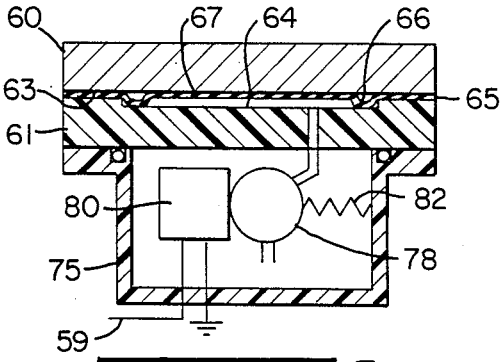
FIG. 5 is another cross-sectional view taken about lines 5—5 of FIG. 3.

A preferred form of sensor element 48 is a LAMBDA sensor manufactured and sold by Robert Bosch GmbH, Stuttgart, Germany. This sensor is placed upstream of the catalytic converter and works according to the principle of galvanic oxygen concentration cells with solid electrolytes so as to supply an electrical signal via line 49 into the circuit 36. Essentially, the sensor 48 is a thermocouple whose hot junction is at the temperature of the exhaust gases and the cold junction is at ambient temperature. The presence of oxygen in the exhaust modifies the thermocouple material and causes it to generate a signal from zero (oxygen saturation) to one volt (no oxygen); 0.5 volts corresponds to the optimum stoichiometric condition. Most desirably, as illustrated in FIG. 6, the sensor 48 should be installed at the Y-junction of the exhaust line 16 and upstream of the catalytic converter 17 since the LAMBDA sensor is more stable when operated at a temperature on the order of 800° C. Moreover, as represented in FIG. 8, the sensor when employed in combination with the sensing circuit 36 and flow control valve 38 should be calibrated to inject the proper amount of oxygen necessary to maintain the sensor reading at 0.5 volts which is the stoichiometric voltage level or condition. As the LAMBDA sensor 48 referred to is specifically designed for use with unleaded gasoline, it will be appreciated that the type of sensor employed will depend to a great extent on the type of fuel or gasoline utilized.

The signal generated by the sensor 48 is connected in series with a resistor 52 and connected to one side of an amplifier 53. The signal is processed or carried through two stages of amplification by amplifier 53 and amplifier 54. The amplifiers 53 and 54 are LM358 amplifiers having IN753 zener diodes 55 and 56 connected as shown, and a voltage divider 57 at one input to the second stage amplifier 54 is adjusted to 3.0 volts so as to require an input signal from the sensor 48 greater than 0.5 volts to generate a signal at the output of the circuit. The sensor signal is processed through a Darlington transistor series NTE263/TCG186 as illustrated at 58 and emerges as a 0 to 6 volt signal for regulating oxygen flow through the valve 36. The biasing voltage for the circuit is established by the vehicle battery B and its positive lead 40' connected as shown to the transistor complex 58 and the zener diode 55. The emittor side of the transistor 58 is connected via a heat sink 60 to the flow control valve 36. The resistors and capacitors may have the values as indicated in FIG. 6 for the transistors described.

Considering in more detail the construction and arrangement of the preferred form of flow control valve 36, as illustrated in FIGS. 2–5 inclusive, the valve has upper and lower body portions 60 and 61 which are releasably connected together by means of suitable fasteners in the form of screws 62 which extend downwardly through aligned openings in the peripheries of the upper and lower body portions. As seen from a consideration of FIG. 5, the upper body portion 60 has a flat undersurface 63, the lower body portion 61 has a shallow recess 64 in its upper surface, and a diaphram 65 is interposed between the confronting surfaces 63 and 64, the diaphram having a generally circular, downwardly directed rib portion 66 and a raised flexible center section 67. A pressure port 70 in the upper body portion communicates with the outlet of the oxygen cylinder 30, and a key-off valve 71 is solenoid operated so that when the ignition switch is turned on, power is applied over leads 40' and 41' to the solenoid of the valve 71 to open the pressure port 70. An exhaust port 72 also extends downwardly through the upper body poriton 60 and for a limited extent into the lower body portion to communicate with an angled groove 73 extending upwardly from communication with a lower chamber area 75 of the valve unit. The pressure port 71 communicates via a vertical groove 76 and horizontal channel 77 with a flow control valve 78 which extends downwardly through the lower body portion from communication with the central recessed area 67. Normally, the diaphram 65 is in a position which effectively seals off the flow of oxygen from the pressure supply port 70 to the exhaust port. However, when a signal is applied from the sensor circuit over line 59 through the solenoid 80 in the lower chamber area, it will overcome the urging of spring loading member 82 to withdraw a valve member away from a valve seat at the end of valve 78 and permit flow of oxygen therethrough. The degree of opening of the valve 78 is proportional to the voltage level applied by the sensing circuit over line 59 so that the flow of oxygen through the valve 78 into the chamber 75 for exhaust through the exhaust port 72 will be proportional to the signal generated by the sensor 48.

Figure 7:
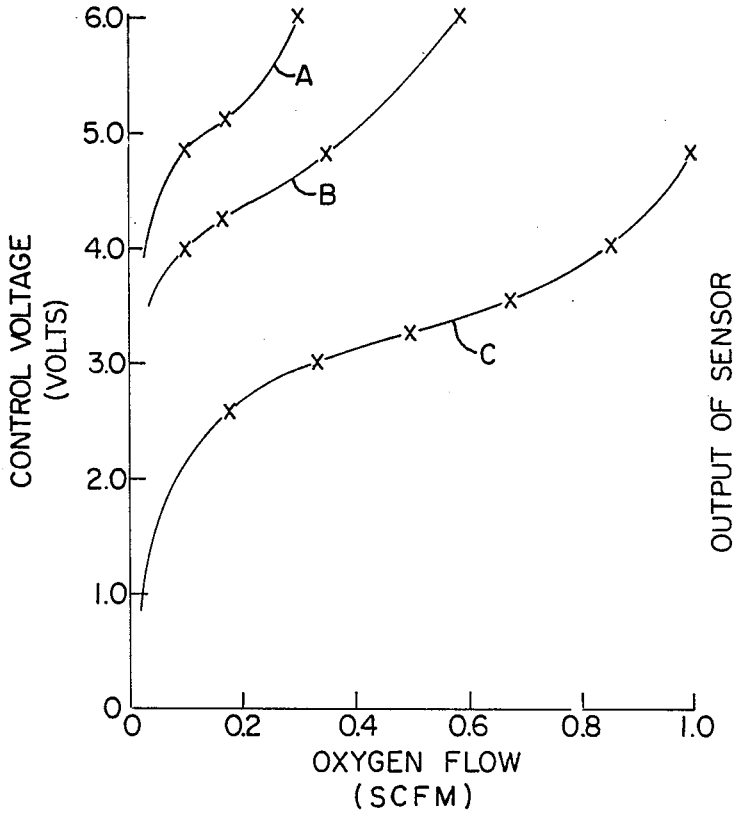
FIG. 7 is a graph of oxygen flow for a given control voltage.

Referring to FIG. 7, operating curves illustrate the mass rate of flow of oxygen for different oxygen pressure levels in the cylinder 30. Thus, curve A is for a pressure level of 5 psid, curve B is for a pressure level of 10 psid, and curve C represents a pressure level of 20 psid. The output signal from the sensing circuit will vary over a range of 3 to 6 volts and, for each of the different pressure levels represented, as the voltage of the signal increases the mass rate of oxygen flow will increase over a range of 0 to 1 scfm. Again, by reference to FIG. 8, the signal generated by the sensor 48 will range from 0 to 1.0 volts and, only if that signal is in excess of the optimum stoichiometric condition at 0.5 volts will the sensing circuit respond to generate an amplified signal causing the flow control valve 38 to open. For example, 1,000 ppm hydrocarbons and 6% carbon monoxide would produce a voltage at the output of the sensor 48 corresponding to about 0.8 volts. This output voltage operates through the circuit 38 to open the valve 36 for the introduction of oxygen from the cylinder 30 into the induction pipe 26 until the voltage is once again reduced to 0.5 volts at the output of the sensor 48.

The particular combination of elements comprising the sensor 48, sensing circuit 38 and flow control valve 36 are designed specifically for use in connection with an internal combustion engine of a motor vehicle. However, the principles of application and necessary modification for different types of fuel and fuel/air injection systems will be readily apparent. It is therefore to be understood that various modifications and changes may be made in the construction and arrangement of parts comprising the preferred form of the present invention as well as in the sequence of steps followed without departing from the spirit and scope of the present invention as designed by the appended claims.

I claim:

1. The method for maintaining an optimum stoichiometric condition in an engine having a fuel/air mixture device in which an air stream is mixed with fuel comprising the steps of sensing the amount of pollutants in the exhaust gas from the engine, generating an electrical signal representing the amount of pollutants in the exhaust, amplifying said signal into a control voltage signal, providing a supplementary source of oxygen under pressure, interposing a flow control valve between said source of oxygen and said fuel/air mixing device, and regulating the degree of opening of said flow control valve in proportion to the control voltage signal generated whereby to regulate the mass rate of oxygen flow delivered from said source of oxygen into said fuel/air mixing device in order to reduce the ratio of nitrogen to oxygen in the air stream.

2. The method according to claim 1, including the step of producing a control voltage signal, only if the electrical signal from the exhaust represents a pollutant level in the combustion gases above the stoichiometric condition of the engine.

3. The method according to claim 1, including the step of measuring the pollutant level in the spent combustion gases at the exhaust manifold of the engine.

4. A method for reducing the pollutant level in the exhaust of an internal combustion engine resulting from incomplete combustion comprising the steps of sensing the pollutant level in the exhaust fumes of the engine and producing an amplified electrical signal proportional to the concentration of pollutants, providing a supplementary oxygen source under pressure in addition to the oxygen contained in the air stream delivered for mixture with the fuel in the carburetor of the engine, regulating the amount of oxygen delivered from the supplementary oxygen source into the air stream in direct proportion to the electrical signal generated whereby to reduce the ratio of nitrogen to oxygen in the air stream, and continuously monitoring the pollutant level in relation to the oxygen delivered to the air stream from the supplementary oxygen source.

5. The method according to claim 4, including the step of delivering oxygen from said supplementary oxygen source to said fuel/air mixing device at a predetermined pressure level.

6. Apparatus for maintaining the stoichiometric condition of a combustion engine wherein a carburetor is provided to delivery a fuel/air mixture for combustion into the engine and a pollutant sensor is provided in the exhaust of the engine to continuously generate electrical signals proportional to the level of pollutants in the spent combustion gases from the engine, the improvement comprising:

a source of oxygen under pressure in adidtion to the oxygen contained in the fuel/air mixture;

conduit means interconnecting said oxygen source and said carburetor;

electronic circuit sensing means responsive to electrical signals in said pollutant sensor to generate amplified control voltage signals in direct proportion to the level of said electrical signal received; and flow control valve means associated with said oxygen source including an adjustable valve member responsive to the voltage level of the control voltage signals from said sensing circuit to open said valve for the flow of oxygen from said oxygen source into said carburetor at a flow rate correlated with the electrical signals received from said pollutant sensor whereby to reduce the ratio of nitrogen to oxygen in the fuel/air mixture.

7. Apparatus according to claim 6, wherein said sensing means is operative to generate control voltage signals only when the signals received from said pollutant sensor are above a predetermined stoichiometric condition.

8. Apparatus according to claim 6, said flow control valve means including an intake port communicating with said oxygen source, a normally closed on-off valve at said intake port, and a solenoid electrically connected to said ignition switch for said engine for opening said on-off valve when said ignition switch is turned on.

9. Apparatus according to claim 8 including an exhaust port communicating with said carburetor, a throttle valve interposed between said intake port and said exhaust port and including a valve member movable toward and away from a valve seat in said throttle valve to regulate the flow rate of air through said exhaust port, and adjustable control means associated with said valve member to meter the flow rate of oxygen through said throttle valve in direct proportion to the voltage level of said control voltage signal from said sensing means.

10. Apparatus according to claim 6, said sensing means amplifying said signals from said pollutant sensor from the range of 0 to 1 volt to a range of 0 to 6 volts, and a voltage divider for adjusting said sensing means to amplify said electrical signals representing a pollutant level above the stoichiometric condition of said engine.

* * * * *